US009044628B2

(12) United States Patent
Seebaluck et al.

(10) Patent No.: US 9,044,628 B2
(45) Date of Patent: Jun. 2, 2015

(54) FIRE SUPPRESSION SYSTEM

(75) Inventors: Dharmendr Len Seebaluck, Wake Forest, NC (US); Terry Simpson, Wake Forest, NC (US); Robert Glaser, Stella, NC (US)

(73) Assignee: Kidde Technologies, Inc., Wilson, NC (US)

( * ) Notice: Subject to any disclaimer, the term of this patent is extended or adjusted under 35 U.S.C. 154(b) by 878 days.

(21) Appl. No.: 12/816,416

(22) Filed: Jun. 16, 2010

(65) Prior Publication Data

US 2011/0308822 A1 Dec. 22, 2011

(51) Int. Cl.
*A62C 2/00* (2006.01)
*A62C 2/06* (2006.01)

(52) U.S. Cl.
CPC ..... *A62C 2/06* (2013.01)

(58) Field of Classification Search
CPC ..... A62C 99/00; A62C 99/0018; A62C 35/38
USPC ..... 169/43, 46, 48, 49, 50
See application file for complete search history.

(56) References Cited

U.S. PATENT DOCUMENTS 4,036,024 A * 7/1977 Dreker et al. ..... 405/132
4,688,183 A 8/1987 Carll et al.
4,763,731 A 8/1988 Adams et al.
4,772,680 A 9/1988 Noomen et al.
5,188,186 A * 2/1993 Nash ..... 169/48
5,501,284 A 3/1996 Clodfelter et al.
5,622,438 A 4/1997 Walsh et al.
5,848,650 A 12/1998 Brady
5,899,275 A 5/1999 Okamoto et al.
5,908,074 A 6/1999 Potts
5,912,195 A 6/1999 Walla et al.
6,003,608 A 12/1999 Cunningham
6,053,256 A 4/2000 Lu
6,082,464 A 7/2000 Mitchell et al.
6,095,251 A 8/2000 Mitchell et al.
6,181,426 B1 1/2001 Bender et al.
6,314,754 B1 11/2001 Kotliar
6,401,487 B1 6/2002 Kotliar
6,401,590 B1 6/2002 Coakley et al.
6,418,752 B2 7/2002 Kotliar
6,601,653 B2 8/2003 Grabow et al.
6,896,067 B2 5/2005 Bowyer et al.
6,913,636 B2 7/2005 Defrancesco et al.
6,935,433 B2 8/2005 Gupta
6,997,970 B2 2/2006 Crome (Continued)

FOREIGN PATENT DOCUMENTS

EP 2233175 A1 9/2010
GB 2108839 A * 5/1983 ..... A62C 3/14

(Continued)

OTHER PUBLICATIONS

U.S. Appl. No. 12/470,817, filed May 22, 2009, entitled, "Fire Suppression System and Method".

(Continued)

*Primary Examiner* — Davis Hwu
(74) *Attorney, Agent, or Firm* — Carlson, Gaskey & Olds

(57) ABSTRACT

A fire suppression system includes a volume reduction system having a seal member. The seal member is selectively deployable between a first position and a second position to seal an opening in a confined space.

18 Claims, 4 Drawing Sheets

(56) References Cited

U.S. PATENT DOCUMENTS

| | | | |
|---|---|---|---|
| 7,040,576 | B2 | 5/2006 | Noiseux et al. |
| 7,066,274 | B2 | 6/2006 | Lazzarini |
| 7,073,994 | B2 | 7/2006 | Huer et al. |
| 7,093,666 | B2 | 8/2006 | Trumper |
| 7,207,392 | B2 | 4/2007 | Kotliar |
| 7,223,351 | B2 | 5/2007 | Sharma et al. |
| 7,232,097 | B2 | 6/2007 | Noiseux et al. |
| 7,273,507 | B2 | 9/2007 | Schwalm |
| RE40,065 | E | 2/2008 | Kotliar |
| 7,331,401 | B2 | 2/2008 | Bobenhausen |
| 7,333,129 | B2 | 2/2008 | Miller et al. |
| 7,464,992 | B1 | 12/2008 | Ozment |
| 7,509,968 | B2 | 3/2009 | Surawski |
| 7,686,093 | B2 | 3/2010 | Reilly et al. |
| 7,688,199 | B2 | 3/2010 | Zhang et al. |
| 2001/0029750 | A1 | 10/2001 | Kotliar |
| 2002/0040940 | A1 | 4/2002 | Wagner et al. |
| 2002/0088250 | A1 | 7/2002 | Kotliar |
| 2008/0290216 | A1 | 11/2008 | Lessi et al. |

FOREIGN PATENT DOCUMENTS

| | | |
|---|---|---|
| JP | 6079010 A | 3/1994 |
| WO | 9411613 | 5/1994 |

OTHER PUBLICATIONS

Extended European Search Report for Application No. EP 10 25 0546 dated May 25, 2010.

European Search Report and Written Opinion for European Application No. EP 11 17 0203 completed on Apr. 17, 2013.

* cited by examiner

FIRE SUPPRESSION SYSTEM

BACKGROUND OF THE INVENTION

This disclosure relates to a fire suppression system, and more particularly to a fire suppression system having a volume reduction system.

Fire suppression systems are often used in aircraft, buildings or other structures having confined spaces. Some fire suppression systems utilize halogenated fire suppressants, such as halons. However, halogens are believed to play a role in ozone depletion of the atmosphere.

Fire suppression systems have been proposed that utilize onboard inert gas generating systems (OBIGGS), in combination with stored inert gas, which utilize more environmental friendly fire suppressant agents. Space and weight limitations have limited the ability to incorporate onboard inert gas generating fire suppressant systems in a cost effective manner, particularly in aviation applications. For example, many aircraft include cargo bays having open or slotted floors that effectively make the aircraft bilge part of the cargo bay. Therefore, the volume of agent required to suppress a fire is increased, sometimes by as much as 20%. In addition, the amount of airflow leakage that occurs within the cargo bay further increases the amount of agent required to suppress a fire threat.

SUMMARY

A fire suppression system includes a volume reduction system having a seal member. The seal member is selectively deployable between a first position and a second position to seal an opening in a confined space.

In another exemplary embodiment, a fire suppression system includes a high pressure inert gas source, a low pressure inert gas source, a distribution network and a volume reduction system. The high pressure inert gas source is configured to provide a first inert gas output, while the low pressure inert gas source is configured to provide a second inert gas output. The distribution network connects the high pressure inert gas source and the low pressure inert gas source to distribute the first inert gas output and the second inert gas output throughout a confined space. The volume reduction system is positioned within the confined space and includes a seal member. The seal member is selectively deployable between a first position and a second position to isolate a first volume of the confined space from a second volume of the confined space and reduce an amount of the first inert gas output and the second inert gas output that is required to respond to a fire threat within the confined space.

A method for use with a fire suppression system that responds to a fire threat within a confined space includes isolating a first volume of the confined space from a second volume of the confined space, and blocking an airflow leakage within the confined space.

The various features and advantages of this disclosure will become apparent to those skilled in the art from the following detailed description. The drawings that accompany the detailed description can be briefly described as follows.

DETAILED DESCRIPTION

Figure 1:
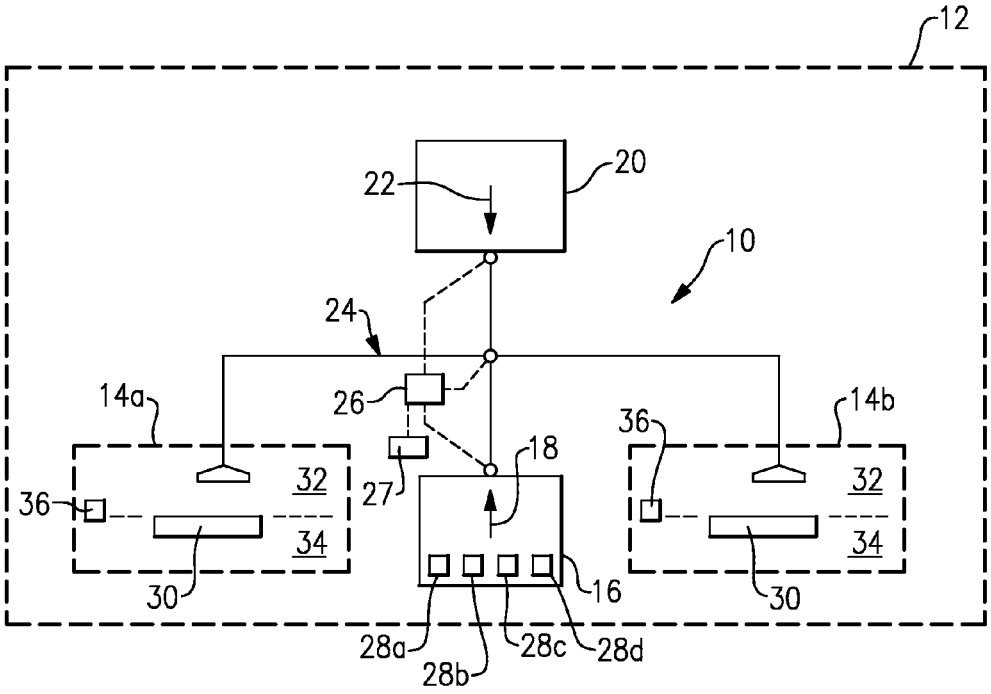
FIG. 1 illustrates an example fire suppression system.

FIG. 1 illustrates selected portions of an example fire suppression system 10 that may be used to control a fire threat. The fire suppression system 10 may be utilized with an aircraft 12 (shown schematically); however, it is to be understood that the exemplary fire suppression system 10 may alternatively be utilized in other types of structures.

In this example, the fire suppression system 10 is implemented within the aircraft 12 to control any fire threats that may occur in confined spaces 14*a* and 14*b*. For instance, the confined spaces 14*a* and 14*b* may be cargo bays, electronic bays, wheel wells or other confined spaces where fire suppression is desired. The fire suppression system 10 includes a high pressure inert gas source 16 for providing a first inert gas output 18, and a low pressure inert gas source 20 for providing a second inert gas output 22. For example, the high pressure inert gas source 16 provides the first inert gas output 18 at a higher mass flow rate than the second inert gas output 22 from the low pressure inert gas source 20.

The high pressure inert gas source 16 and the low pressure inert gas source 20 are connected to a distribution network 24 that distributes the first and second inert gas outputs 18, 22. In this case, the first and second inert gas outputs 18, 22 may be distributed to the confined space 14*a*, confined space 14*b*, or both, depending upon where a fire threat is detected. As may be appreciated, the aircraft 12 may include additional confined spaces that are also connected within the distribution network 24 such that the first and second insert gas outputs 18 and 22 may be distributed to any or all of the confined spaces.

The fire suppression system 10 also includes a controller 26 that is operatively connected with at least the distribution network 24 to control how the respective first and second inert gas outputs 18 and 22 are distributed through the distribution network 24. The controller 26 may include hardware, software, or both. For instance, the controller 26 may control whether the first inert gas output 18 and/or the second inert gas output 22 are distributed to the confined spaces 14*a*, 14*b* and at what mass and mass flow rate the first inert gas output 18 and/or the second inert gas output 22 are distributed.

The controller 26 of the fire suppression system 10 may be in communication with other onboard controllers or warning systems 27 such as a main controller or multiple distributed controllers of the aircraft 12, and a controller (not shown) of the low pressure inert gas source 20. For instance, the other controllers or warning systems 27 may be in communication with other systems of the aircraft 12, including a fire threat detection system for detecting a fire within the confined spaces 14*a*, 14*b* and issuing a fire threat signal in response to a detected fire threat. In another example, the warning systems 27 include their own sensors for detecting a fire threat within confined spaces 14*a*, 14*b* of the aircraft 12.

As an example, the controller 26 may initially cause the release of the first inert gas output 18 within the confined space 14*a* in response to a fire threat signal from the warning systems 27 to reduce an oxygen concentration within the confined space 14*a* below a predetermined threshold. The controller 26 may cause the release of the second inert gas output 22 to the confined space 14*a* to facilitate maintaining the oxygen concentration below the predetermined threshold. In one example, the predetermined threshold may be less than a 13% oxygen concentration level, such as 12% oxygen concentration, within the confined space 14*a*. The threshold may also be represented as a range, such as 11.5% to 12%. A premise of setting the threshold below 12% is that ignition of aerosol substances, which may be found in passenger cargo in a cargo bay, is limited (or in some cases prevented) below a 12% oxygen concentration. As an example, the threshold may be established based on cold discharge (i.e., no fire case) of the first and second inert gas outputs 18, 20 in an empty cargo bay with the aircraft 12 grounded and at sea level air pressure.

In this example, the high pressure inert gas source 16 is a pressurized inert gas source. The high pressure inert gas source 16 may include a plurality of storage tanks 28*a*-28*d*. The tanks may be made of lightweight materials to reduce the weight of the aircraft 12. Although four storage tanks 28*a*-28*d* are shown, it is to be understood that additional storage tanks or fewer storage tanks may be used in other implementations. The number of storage tanks 28*a*-28*d* may depend on the sizes of the confined space 14*a*, the confined space 14*b* (or other confined spaces), leakage rates of the confined spaces, ETOPS (Extended-range Twin-engine Operational Performance Standards) times, or other factors. Each of the storage tanks 28*a*-28*d* holds pressurized inert gas, such as nitrogen, helium, argon or a mixture thereof. The inert gas may also include trace amounts of other gases, such as carbon dioxide.

The low pressure inert gas source 20 may be a known onboard inert gas generating system (e.g., "OBIGGS") for providing a flow of inert gas, such as nitrogen enriched air, to the aircraft 12. Nitrogen enriched air includes a higher concentration of nitrogen than ambient air. In general, the low pressure inert gas source 20 receives input air, such as compressed air from a compressor stage of a gas turbine engine of the aircraft 12 or air from one of the confined spaces 14*a*, 14*b* that is compressed by an ancillary compressor, and separates the nitrogen from the oxygen in the input air to provide an output that is enriched in nitrogen compared to the input air. The output nitrogen enriched air may be used as the second inert gas output 22. The low pressure inert gas source 20 may also utilize input air from a second source, such as cheek air, secondary compressor air from a cargo bay, etc., which may be used to increase capacity on demand. As an example, the low pressure inert gas source 20 may be similar to the systems described in U.S. Pat. No. 7,273,507 or U.S. Pat. No. 7,509,968 but are not specifically limited thereto.

The example fire suppression system 10 further includes a volume reduction system 30 positioned within one or more of the confined spaces 14*a*, 14*b*. The volume reduction system 30 generally isolates a first volume 32 of the confined spaces 14*a*, 14*b* from a second volume 34 of the confined spaces 14*a*, 14*b*. A leakage reduction system 36 may also be positioned within one or more of the confined spaces 14*a*, 14*b* for reducing an airflow leakage of the confined spaces 14*a* and 14*b*. As may be appreciated, the fire suppression system 10 can include only the volume reduction system 30, only the leakage reduction system 36, or both systems.

Figure 2:
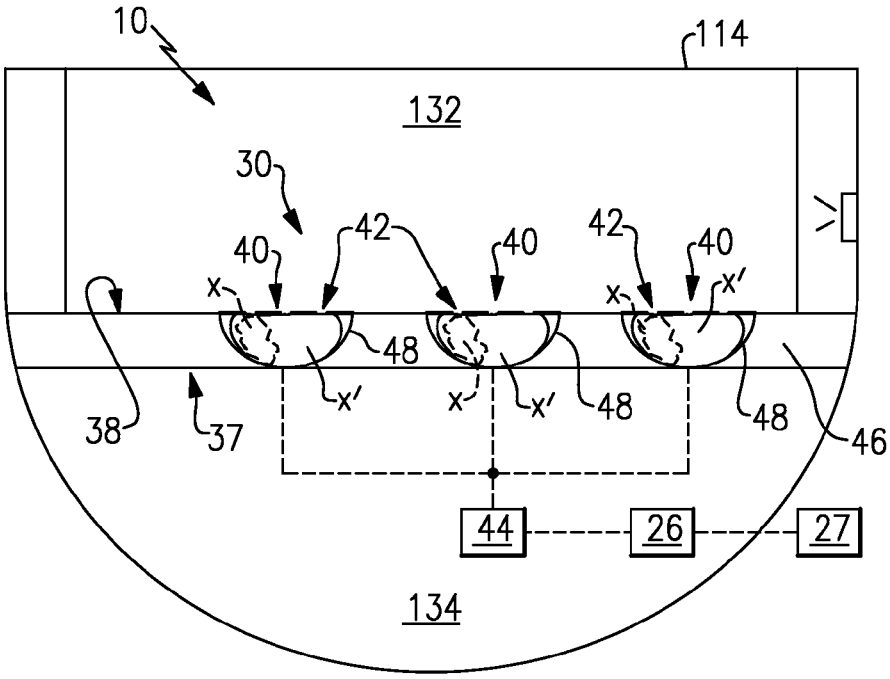
FIG. 2 illustrates an example volume reduction system for use with a fire suppression system.

FIG. 2 illustrates an example volume reduction system 30 positioned within a confined space 114. In this disclosure, like reference numerals designate like elements where appropriate, and reference numerals with the addition of 100 designate modified elements. The modified elements may incorporate the same features and benefits of the corresponding original elements and vice versa. The fire suppression system 10 including the volume reduction system 30 is implemented in a confined space 114 of an aircraft 12, but may alternatively be implemented in other types of structures.

In this example, the confined space 114 is a cargo bay of an aircraft. The confined space 114 includes a floor 38 that separates the confined space 114 between a first volume 132 (e.g., a cargo bay volume) and a second volume 134 (e.g., a bilge volume). The floor 38 includes a plurality of horizontally disposed beam structures 46 that extend across the confined space 114. On some aircraft, the floor 38 is not sealed and allows communication of the cargo bay atmosphere with the bilge atmosphere. In this example, the floor 38 includes a slotted floor having a plurality of openings 42 that allow communication of the cargo bay atmosphere with the bilge atmosphere.

The volume reduction system 30 is positioned within the confined space 114 to isolate the first volume 132 from the second volume 134 during a fire threat to limit cargo bay volume and minimize the amount of inert gas required from both inert gas sources 16, 20 to respond to a fire threat. In this example, the volume reduction system 30 includes seal members 40 that are deployable to seal off the openings 42 of the floor 38. As may be appreciated, the floor 38 may include a plurality of floor openings 42, and at least one seal member 40 could be positioned relative to each opening 42 to seal the opening 42 during a fire threat.

In this example, the seal members 40 include inflatable tubes or airbags. In response to detection of a fire threat, the seal members 40 are deployed from a first, deflated position X (shown in phantom lines) to a second, inflated position X' to seal or substantially close off the openings 42 of the floor 38. The seal members 40 are inflated via a gas source 44. In one example, the gas source 44 is provided by the high pressure inert gas source 16 of FIG. 1. In another example, the gas source 44 of the volume reduction system 30 includes a dedicated stored gas bottle, gas generator, or gas generator air aspirator that can be used to inflate the seal members 40 and respond to a fire threat.

The volume reduction system 30 communicates with the controller 26 to respond to a fire threat signal communicated from the warning systems 27. Once the fire threat signal is received, the controller 26 commands the volume reduction system 30 to deploy the seal members 40, such as by inflating the tubes, to seal the openings 42 of the floor 38.

The seal member 40 includes a fire resistant material. One example fire resistant material is NOMEX®, a DuPont product. As may be appreciated, the seal members could include any fire resistant material.

The seal members 40 of the volume reduction system 30 are positioned relative to the floor 38 of the confined space 114. In this example, the seal members 40 are attached to an underside 37 of the floor 38. The seal members 40 extend longitudinally (into the page) between each beam structure 46 of the floor 38. The seal members 40 are attached relative to the floor 38 with a restraint member 48. The restraint member 48 may include a strap, band, netting, adhesive, clamp or any other suitable restraint that prevents displacement of the seal members 40 downwardly into the second volume 134 (i.e., the bilge).

Figure 3:
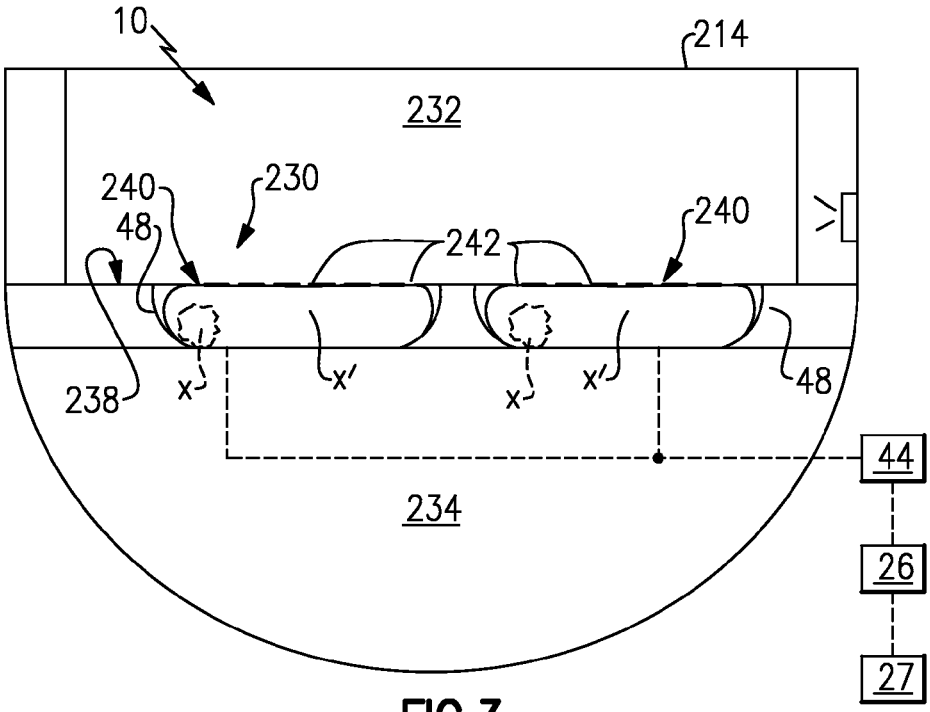
FIG. 3 illustrates another example volume reduction system for use with a fire suppression system.

FIG. 3 illustrates another example volume reduction system 230 positioned within a confined space 214. The confined space 214 includes a floor 238 having a plurality of openings 242. In this example, the floor 238 is a grilled floor.

The volume reduction system 230 includes a plurality of seal members 240. In this example, the seal members 240 are inflatable bags or mats that are made of a fire resistant material and that are deployable to seal or substantially close off the openings 242 of the floor 238. The seal members 240 are deployable between a first position X (shown in phantom lines) and a second position X' to seal the openings 242, and therefore isolate a first volume 232 from a second volume 234 to reduce the amount of agent required to respond to a fire threat within the confined space 214. A restraint member 48 attaches the seal members 240 relative to the floor 238.

The volume reduction system 230 communicates with the controller 26 to respond to a fire threat signal communicated from a warning system 27. Once the fire threat signal is received, the controller 26 commands the volume reduction system 230 to deploy the seal members 240, such as by inflating the bags or mats with the gas source 44, to seal the openings 242 of the floor 238.

Figure 4:
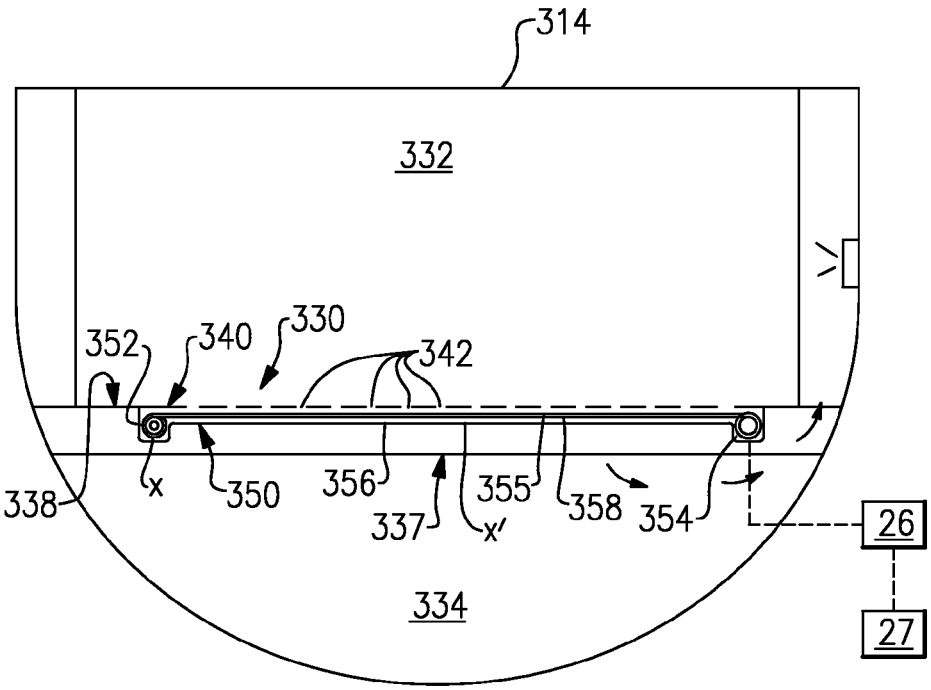
FIG. 4 illustrates another example volume reduction system for use with a fire suppression system.

FIG. 4 illustrates another example volume reduction system 330 positioned within a confined space 314. In this example, the confined space 314 includes a floor 338 having a grilled floor structure that includes a plurality of openings 342. A seal member 340 is deployable to seal the openings 342 and isolate a first volume 332 from a second volume 334 of the confined space 314.

In this example, the seal member 340 includes a roller screen assembly 350. The roller screen assembly 350 includes a screen storage housing 352, an actuator motor 354, a sealed guide track 356 that extends between the screen storage housing 352 and the actuator motor 354, a pull device 355 and a roller screen 358 made of a fire resistant material. In response to a fire threat, the folded roller screen 358 is deployed from the storage housing 352 (first position X) and is unrolled via the pull device 355 along the sealed guide track 356 by the actuator motor 354 (second position X') to seal the openings 342 of the floor 338 and reduce the amount of agent required to respond to a fire threat within the confined space 314. The pull device 355 can include a cable, piston actuators, gear drives or other suitable pulling devices. In this example, the roller screen assembly 350 is mounted to an underside 337 of the floor 338 in a known manner.

The volume reduction system 330 communicates with the controller 26 to respond to a fire threat signal communicated from a warning system 27. Once the fire threat signal is received, the controller 26 commands the volume reduction system 330 to deploy the seal member 340, such as by unrolling the roller screen 358 via the actuator motor 354, to seal the openings 342 of the floor 338. The volume reduction system 330 cooperates with the controller 26 to seal off the first volume 332 from the second volume 334, thus minimizing the amount of inert gas required to respond to the fire threat signal.

Figure 5:
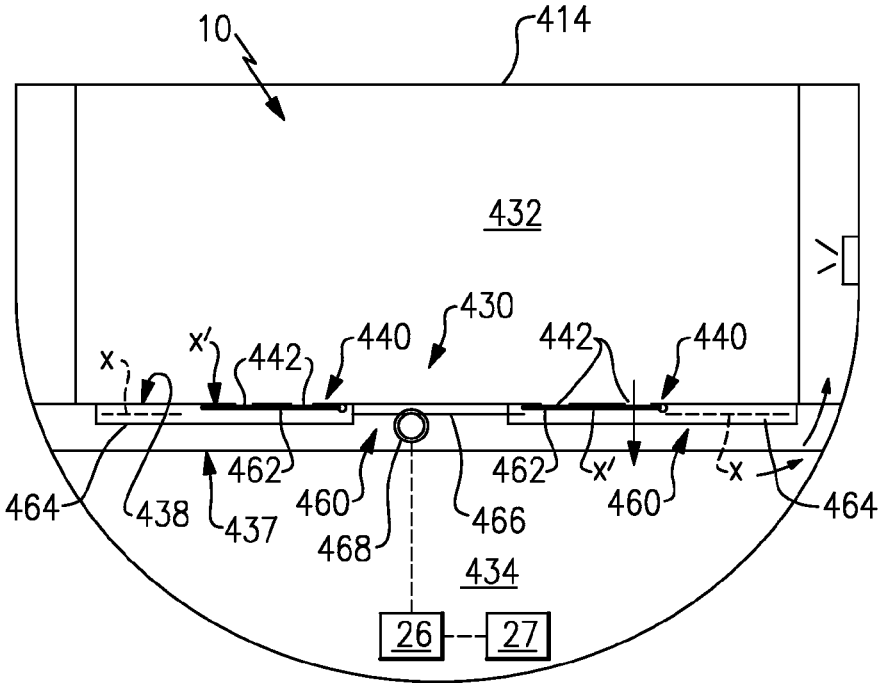
FIG. 5 illustrates yet another example volume reduction system for use with a fire suppression system.

FIG. 5 illustrates another example volume reduction system 430 positioned within a confined space 414. The confined space 414 includes a floor 438 having a plurality of openings 442. In this example, the floor 438 includes a slotted floor structure. The example volume reduction system 430 includes a plurality of seal members 440 that are deployable to seal the floor openings 442 to isolate a first volume 432 from a second volume 434 of the confined space 414.

In this example, the seal members 440 include a sliding door panel assembly 460. In this example, the sliding door panel assembly 460 is mounted to an underside 437 of the floor 438 in a known manner. The sliding door panel assembly 460 includes a sliding door panel 462, a sealed guide track 464, a pull device 466 and a cable actuator motor 468. In response to a fire threat in the confined space 414, the actuator motor 468 begins pulling the pull device 466. The pull device 466 can include a cable, piston actuators, gear drives or other suitable pulling devices. The pull device 466 is connected to the sliding door panel 462, which pulls the slider door panel 462 between a first, stowed position X (shown in phantom lines) and a second, deployed position X' along the sealed guide track 464. In the deployed position, the sliding door panel 462 seals the openings 442 of the floor 438 to substantially isolate the first volume 432 from the second volume 434 of the confined space 414.

The volume reduction system 430 communicates with the controller 26 to respond to a fire threat signal communicated from a warning system 27. Once the fire threat signal is received, the controller 26 commands the volume reduction system 430 to deploy the seal members 440, such as by closing the sliding door panels 462, to seal the openings 442 of the floor 438.

Figure 6:
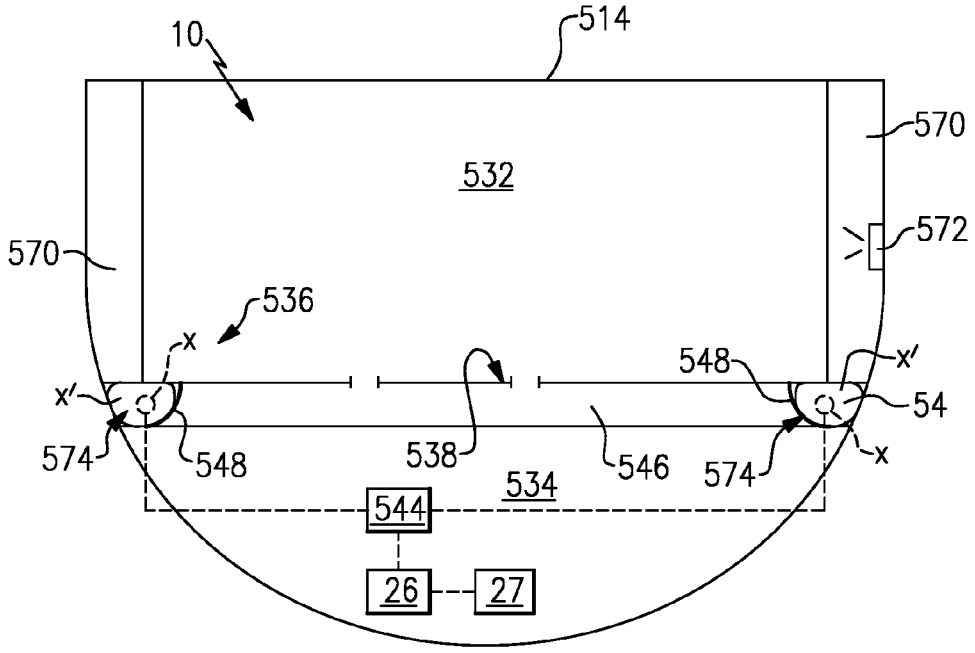
FIG. 6 illustrates an example leakage reduction system for use with a fire suppression system.

FIG. 6 illustrates an example leakage reduction system 536 for reducing airflow leakage of the confined space 514. The leakage reduction system 536 may be used either apart from or in combination with any of the example volume reduction systems 30, 230, 330, or 430. The confined space 514 includes a cheek 570. The cheek 570 is a compartment external to the cargo bay of an aircraft 12 but internal to the aircraft 12 skin. An outflow valve 572 limits the differential pressure between the interior of the aircraft and the exterior environment, and therefore impacts the differential pressure between the cargo bay/bilge volumes and the cheek volume.

Airflow from a first volume 532 (the cargo bay) and a second volume 534 (the bilge) of the confined space 514 may escape from the confined space 514 into the cheek 570. Airflow leakage can increase the amount of agent required to maintain the oxygen concentration of the confined space 514 below a predetermined threshold. Accordingly, the fire suppression system 10 can include the leakage reduction system 536 having a seal member 574 that is deployable to block and/or reduce airflow lockage within the confined space 514.

Figure 7:
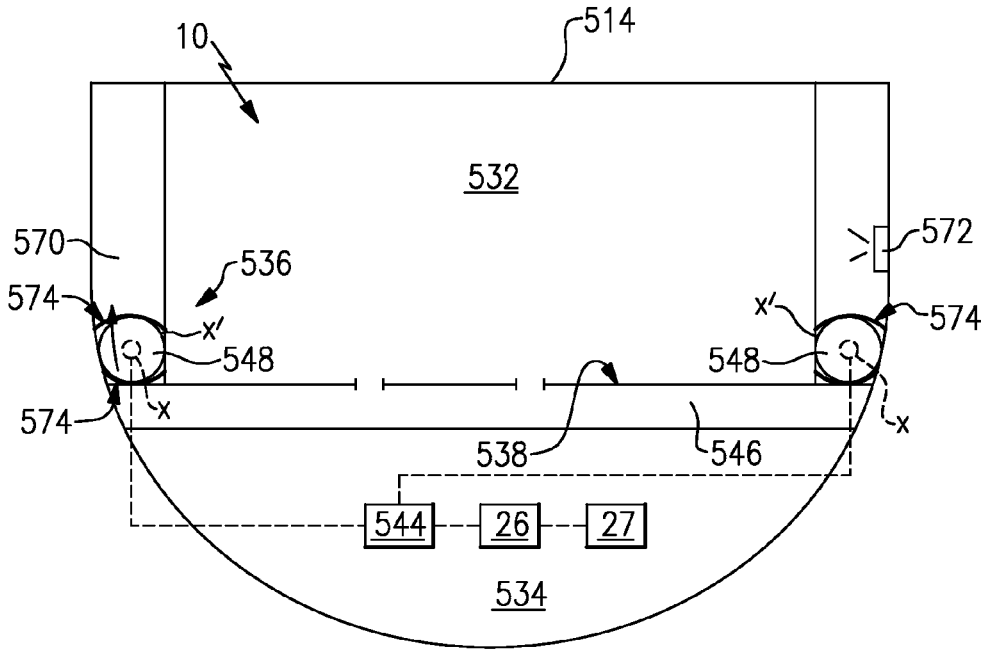
FIG. 7 illustrates another example leakage reduction system for use with a fire suppression system.

The seal member 574 can include an inflatable tube, airbag, mat or any other fire resistant seal member that is inflatable to reduce the amount of airflow leakage between the cargo bay 532, bilge 534 and cheek 570 of the confined space 514. In one example, the seal members 574 are positioned between portions of the beam structures 546 of the floor 538 of the confined space 514 that are adjacent to the cheek 570. In another example, the seal members 574 are mounted within the cheek 570 (See FIG. 7). As may be appreciated, at least one seal member 574 may be positioned at any known area of airflow leakage within the confined space 514.

The seal member 574 are deployable between a first position X (shown in phantom lines) and a second position X' to substantially seal the cheek 570 from the first volume 532 and/or the second volume 534 of the confined space 514. As may be appreciated, the leakage reduction system 536 may employ a plurality of seal members 574 for accomplishing the reduction in airflow leakage.

The seal members 574 are inflated via a gas source 544. The gas source 544 may be provided by the high pressure inert gas source 16 of FIG. 1, a dedicated stored gas bottle, gas generator, gas generator air aspirator or other suitable gas source.

A restraint member 548 maintains a desired positioning of the seal members 574 of the leakage reduction system 536. The restraint member 548 includes straps, bands, netting, adhesives, clamps or any other suitable restraint member.

The leakage reduction system 536 communicates with the controller 26 to respond to a fire threat signal communicated from a warning system 27. Once the fire threat signal is received, the controller 26 commands the leakage reduction system 536 to deploy the seal members 574, such as by inflating the tubes with the gas source 44, to seal the cheek 570.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A fire suppression system, comprising:

a gas source configured to provide a gas output;

a distribution network connected to said gas source and configured to distribute said gas output throughout a confined space of an aircraft;

a volume reduction system including a seal member, wherein said seal member is selectively deployable between a first position and a second position in response to receiving said gas output to seal an opening in said confined space; and said seal member attached to an underside of a floor located within said confined space.

2. The fire suppression system as recited in claim 1, wherein said seal member includes an inflatable tube.

3. The fire suppression system as recited in claim 1, wherein said seal member includes an inflatable mat.

4. The fire suppression system as recited in claim 1, wherein said seal member includes a roller screen assembly.

5. The fire suppression system as recited in claim 1, wherein said seal member includes a sliding door panel assembly.

6. The fire suppression system as recited in claim 1, wherein said seal member is deflated in said first position and is inflated in said second position.

7. The fire suppression system as recited in claim 1, wherein said volume reduction system includes a plurality of seal members deployable to isolate a first volume of said confined space from a second volume of said confined space.

8. The fire suppression system as recited in claim 1, wherein said seal member includes a fire resistant material.

9. A method for use with a fire suppression system that responds to a fire threat within a confined space, comprising:

attaching a seal member to an underside of a floor located within the confined space, the floor dividing the confined space between a first volume and a second volume;

isolating the first volume of the confined space from the second volume of the confined space at a first location of the confined space by deploying the seal member; and blocking an airflow leakage within the confined space at a second location of the confined space that is different from the first location.

10. The method as recited in claim 9, wherein the first volume includes an aircraft cargo bay and the second volume includes a bilge, and the floor has at least one opening that extends between the aircraft cargo bay and the bilge, and the step of isolating includes:

deploying the seal member to seal the at least one opening and isolate the aircraft cargo bay from the bilge.

11. The method as recited in claim 10, wherein the step of deploying a seal member includes:

inflating one of a tube and a mat.

12. The method as recited in claim 10, wherein the step of deploying a seal member includes:

positioning one of a roller screen and a sliding door panel to seal the at least one opening of the floor.

13. The method as recited in claim 9, wherein the confined space includes a cheek, and the step of blocking an airflow leakage within the confined space includes:

deploying a second seal member to block the airflow leakage from escaping from the first volume and the second volume into the cheek.

14. The fire suppression system as recited in claim 1, comprising a controller that communicates with said volume reduction system, wherein said controller commands said volume reduction system to deploy said seal member to said second position in response to a fire threat signal.

15. The fire suppression system as recited in claim 1, wherein said seal member obstructs at least one opening of a floor of said aircraft that divides said confined space into a first volume and a second volume in said second position.

16. A fire suppression system, comprising:

a volume reduction system including a seal member, wherein said seal member is selectively deployable between a first position and a second position to seal an opening in a confined space of an aircraft;

wherein said seal member obstructs at least one opening of a floor of said aircraft that divides said confined space into a first volume and a second volume in said second position; and wherein said seal member is mounted to a beam structure of said floor with a restraint member.

17. The fire suppression system as recited in claim 1, wherein said seal member extends longitudinally across a plurality of horizontally disposed beam structures that extend across said confined space.

18. A fire suppression system, comprising:

a volume reduction system positioned within a confined space of an aircraft and including a first seal member, wherein said first seal member is selectively deployable between a first position and a second position to isolate a first volume of said confined space from a second volume of said confined space at a first location of said confined space;

a leakage reduction system including a second seal member that is selectively deployable between a first position and a second position to block airflow at a second location within the confined space that is different from the first location, and said second location is a cheek of said confined space; and a controller in communication with said volume reduction system and said leakage reduction system, wherein said controller deploys said first seal member and said second seal member to said second positions in response to a fire threat signal.

* * * * *